US005255994A

United States Patent [19]

Stein

[11] Patent Number: 5,255,994

[45] Date of Patent: Oct. 26, 1993

[54] ADJUSTABLY TENSIONED SNAP-RELEASE JOINT FOR AN EXERCISE GOLF CLUB

[76] Inventor: Daniel R. Stein, 16504 West Course Dr., Tampa, Fla. 33624

[21] Appl. No.: 824,059

[22] Filed: Jan. 23, 1992

[51] Int. Cl.[5] ..... A63B 69/36; A63B 53/12; A63B 53/08

[52] U.S. Cl. ..... 403/95; 403/96; 403/102; 273/80.1; 273/81 C; 273/81.3; 273/186.2

[58] Field of Search ..... 273/80.1, 81.3, 81 C, 273/186.2; 403/325, 92, 93, 95, 96, 102; 411/348, 393

[56] References Cited

U.S. PATENT DOCUMENTS 4,854,585 8/1989 Koch et al. ..... 273/193
4,856,782 8/1989 Cannan ..... 273/80.1 X

*Primary Examiner*—Randolph A. Reese
*Assistant Examiner*—Christopher J. Novosad
*Attorney, Agent, or Firm*—Oldham, Oldham & Wilson

[57] ABSTRACT

An adjustably tensioned snap-release joint for use as a golf club swing training device is described which includes an upper shaft insert, a lower shaft insert, a screw inserted into a first bore in the lower shaft insert and inserted into a correspondingly threaded second bore in the upper shaft insert, the screw defining a rotation axis of the lower shaft member in relation to the upper shaft member to a transverse axis from a longitudinal axis defined by a linear alignment of the upper and lower shaft inserts in the golf club, an indentation positioned in a co-linear axis with the longitudinal axis of the golf club on an interior surface of the upper shaft insert, and an adjustable spring-biased hollow screw assembly having a ball positioned at the tip of a threaded shaft, capable of exerting pressure on the indentation.

5 Claims, 3 Drawing Sheets

ADJUSTABLY TENSIONED SNAP-RELEASE JOINT FOR AN EXERCISE GOLF CLUB

TECHNICAL FIELD

This invention relates to an adjustably tensioned snap-release joint for use in an exercise golf club. In particular, the device described is particularly applicable for use as a training device by a user in developing his golf swing in a manner which will facilitate the proper contact between a golf ball and the club face.

BACKGROUND OF THE INVENTION

The sport of golf is an activity which enjoys widespread popularity. The skill level of its participants range from the highly skilled professional to the weekend "duffer". However, it is recognized that no matter what the skill level, there are at least two parameters which will assist any golfer in maximizing the potential for the golfer to hit the straightest shot that he is capable of, (1) clean golf club faces; and (2) proper swing and resulting contact of the club face with the golf ball.

Unlike many sports, avid golfers actively engage the game under adverse conditions. The potential for acquiring a build-up of grass and soil on the golf club face is quite significant, even under perfect conditions. There are a variety of cleaning devices and techniques which permit a golfer to resolve the first problem: (1) using a towel or other such cleaning material; (2) using the tee to remove debris from the grooves which are in the golf club face; and (3) using a brush to additionally clean the club face. It is the grooves in the club face which enable a golfer to accurately control the shot. When these grooves are filled in with debris, the control is thereby significantly diminished, leading to frustrating rounds of golf.

Much more difficult to control is the golf swing itself. Without constant professional supervision, any golfer, no matter the skill level, will experience times when the golf swing does not produce the desired results. This is manifested in an abundance of hooks or slices or combinations thereof, as the golfer attempts to make subtle changes in his swing. Without the eye of a trained professional, it is not usually possible for the golfer to determine which component of his swing is causing the undesired result.

Any golf swing has several stages which could be at less-than-optimal positions. The backswing, the peak at which maximum torque is achieved, the forward swing, the wrist snap at moment of contact, etc. At all phases of the swing, it is critical that the club head be in a specified zone with respect to the positioning of the hands. Improper positioning will lead to errant shots and frustrating rounds of golf.

Previous attempts to aid a golfer in "grooving" his swing have included those such as described in U.S. Pat. No. 4,854,585 to Koch et al. In this assembly, a hinge mechanism is described which is interposed between the grip and the club head. The hinge mechanism includes a female member having first and second yoke portions defining a cavity permitting two-way movement of a male member between the yoke portions. An adjusting screw cooperates with a biasing spring and generally spherical member to adjust the force necessary to break or articulate the hinge mechanism.

SUMMARY OF THE INVENTION

In accordance with the present invention, there is provided a simplified adjustably tensioned snap-release joint for use in an exercise golf club.

In particular, it is an object of this invention to detail a training device applicable for use as a training device by a user in developing his golf swing in a manner which will facilitate the proper contact between a golf ball and the club face.

It is a second object of this invention to provide an apparatus which will enable a golfer to self-analyze his swing characteristics in order to determine at which point in the swing, there is an improper positioning of the hands vis-a-vis the club head.

It is a third object of this invention to provide an apparatus which will enable a golfer to adjust the tension required for the snap-release joint to shift out of alignment, thereby permitting the detection of not only gross swing flaws, but also much more subtle ones, and the entire range of defects therein.

These and other objects of this invention will be evident when viewed in light of the drawings, detailed description, and appended claims.

DETAILED DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED COMPONENT PART LIST

Figure 1:
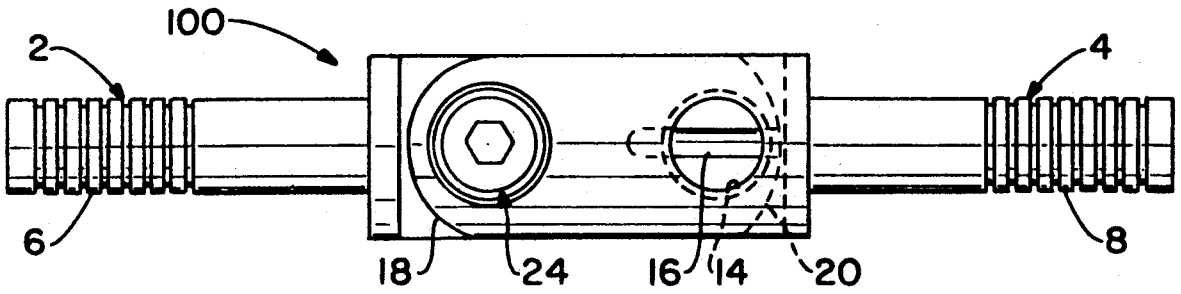
FIG. 1 is a top plan view of the adjustably tensioned snap-release joint insertable into the shaft of an exercise golf club.

| Part Number | Description |
|---|---|
| 2 | upper shaft insert |
| 4 | lower shaft insert |
| 6 | grooved ridges on the upper shaft insert |
| 8 | grooved ridges on the lower shaft insert |
| 10 | pivot screw head |
| 12 | pivot screw threads |
| 14 | adjustably tensioned threaded screw bore |
| 16 | non-beveled interior impinging surface for the tensioned screw |
| 18 | exterior semicircular surface of the lower shaft insert |
| 20 | exterior semicircular surface of the upper shaft insert |
| 22 | beveled interior surface of the upper shaft insert |
| 24 | pivot screw |
| 26 | pivot screw shaft |
| 28 | pivot screw turning means |
| 30 | pivot screw head height |
| 32 | adjustably tensioned screw |
| 34 | washer |
| 36 | washer bore |
| 38 | oblique interior surface |
| 40 | curvilinear peripheral edge of the upper shaft insert |
| 42 | threaded pivot screw receiving bore |
| 44 | circular raised segment of the upper shaft insert |
| 46 | recessed pivot screw head bore |
| 48 | pivot screw shaft bore |
| 50 | circular raised segment of the lower shaft insert |
| 52 | planar interior surface of the upper shaft insert |
| 54 | curvilinear peripheral edge of the lower shaft insert |
| 56 | planar interior face of the lower shaft insert |
| 58 | retaining means for the spring inside the adjustably tensioned screw |
| 60 | adjustably tensioned screw head |
| 62 | adjustably tensioned screw threads |
| 64 | ball |
| 66 | biasing spring |
| 68 | positioning means |
| 100 | adjustably tensioned snap-release joint |

DETAILED DESCRIPTION OF THE INVENTION

Referring now to the drawings wherein the showings are for purposes of illustrating the preferred embodiment of the invention only and not for purposes of limiting the same, the Figures essentially show a user adjustably tensioned snap-release joint for use in an exercise golf club.

More particularly, as shown in FIG. 1, the adjustably tensioned snap-release joint 100 is essentially fabricated from two mating parts. Upper shaft insert 2 is adapted for insertion into the handle portion of the shaft of a golf club, and lower shaft insert 4 is adapted for insertion into the club-face portion of the shaft of a golf club which has been suitably modified at the insertion points. The insertion and subsequent attachment is facilitated by the existence of grooved ridges 6,8 positioned at the extremities of upper shaft insert 2 and lower shaft insert 4 respectively. It is recognized that the alignment of adjustably tensioned snap-release joint 100 is such that the plane defined by the rotation of upper shaft insert 2 and lower shaft insert 4 is coexistent with the plane of the golfer's swing as defined when the golfer is addressing the ball.

Figure 2:
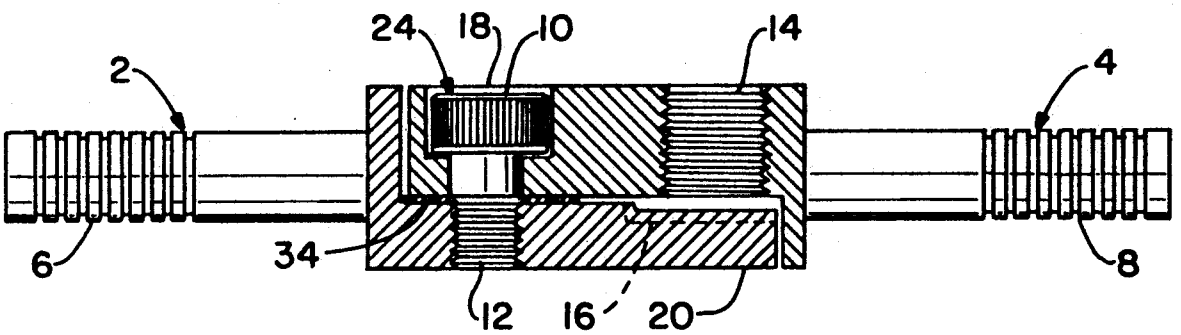
FIG. 2 is a side elevational view in partial cross-section, of the adjustably tensioned snap-release joint insertable into the shaft of an exercise golf club.
Figure 6:
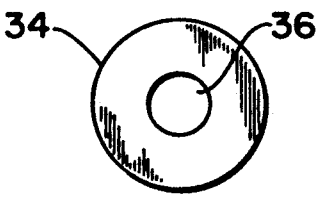
FIG. 6 is a top plan view of the wear washer inserted onto the pivot screw and positioned between the lower shaft insert and the upper shaft insert of the exercise golf club.
Figure 5:
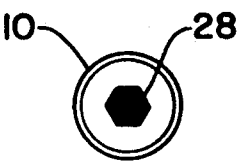
FIG. 5 is a top plan view of the pivot screw.
Figure 4:
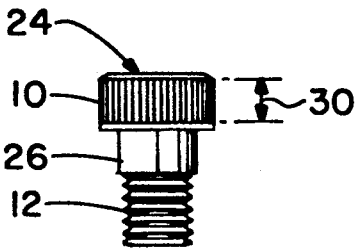
FIG. 4 is a side plan view of the pivot screw which is positioned through the lower shaft insert and into the threaded bore of the upper shaft insert of the exercise golf club.
Figure 11:
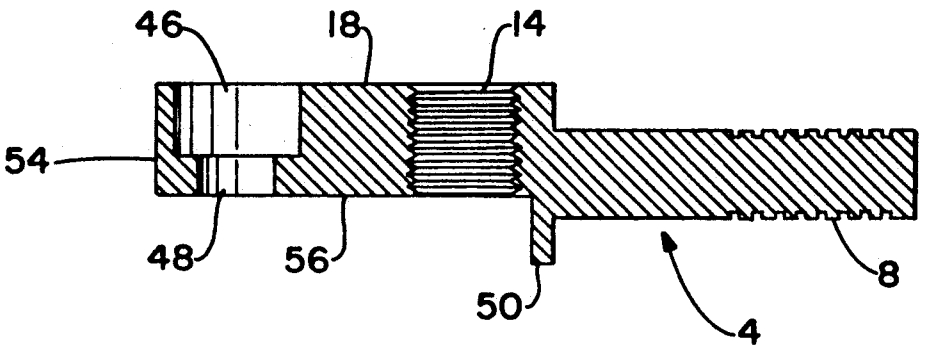
FIG. 11 is a cross-sectional view of the lower shaft insert of the exercise golf club taken along line 11—11 of FIG. 10.

As illustrated more clearly in FIG. 2, upper shaft insert 2 and lower shaft insert 4 are pivotally attached by a pivot screw 24. As shown in FIG. 5, pivot screw 24 is comprised of several component parts. Pivot screw head 10 is mounted on pivot screw shaft 26 upon which pivot screw threads 12 have been cut. In a preferred embodiment, pivot screw 24 is recessed into recessed pivot screw head bore 46 illustrated in FIG. 11. It is recognized that the depth of recessed pivot screw head bore 46 closely approximates the pivot screw head height 30. In order to facilitate the smooth pivoting function of pivot screw 24, washer 34 is inserted onto pivot screw shaft 26 through washer bore 36 and positioned between upper shaft insert 2 and lower shaft insert 4. In a preferred embodiment, this washer is polymeric in nature. In a most preferred embodiment, the washer is teflon. The joining of the upper shaft insert 2 with club-face member 4 is effected by pivot screw threads 12 matingly engaging threaded pivot screw shaft bore 42. In the preferred embodiment, since pivot screw 24 is recessed, pivot screw turning means 28 is provided at the top of pivot screw head 24. In one aspect of this invention, the turning means is by that such as an allen wrench. However, closed geometric polygons shapes, such as three, four, five, etc., are also envisioned. However, it is readily seen that the invention is not limited to such turning means. Conventional turning means, such as flat-head screwdriver slots and Phillips head screwdriver crossed slots are anticipated in addition to other turning means known in the art.

Figure 3:
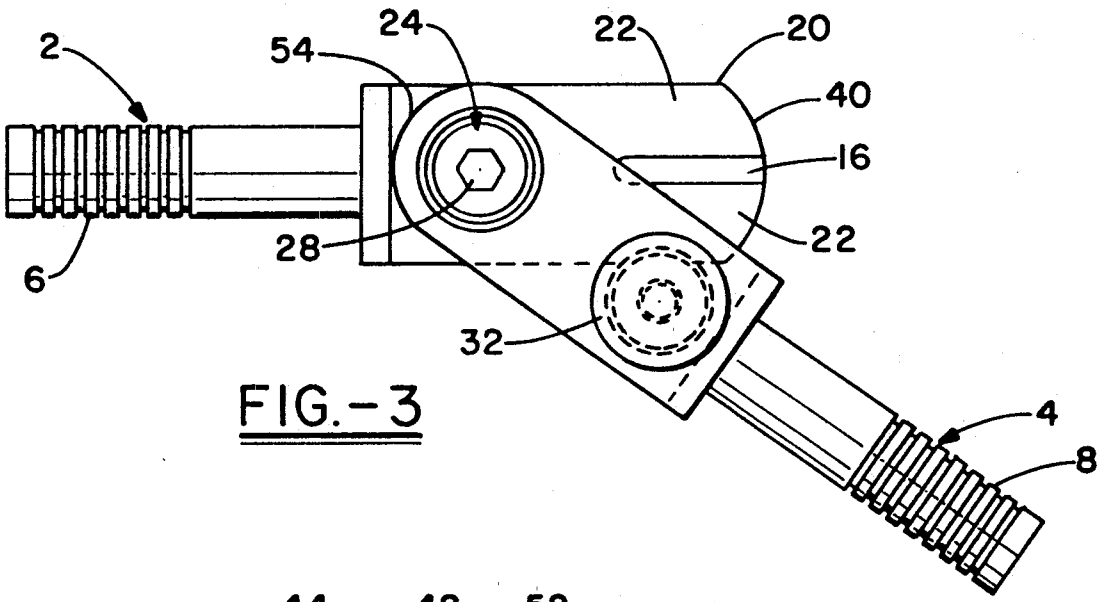
FIG. 3 is a top plan view of the adjustably tensioned snap-release joint insertable into the shaft of an exercise golf club when sufficient force has been exerted on the joint to cause it to separate from its grooved position.

As viewed in operation in FIG. 3, both upper shaft insert 2 and lower shaft insert 4 must have curvilinear peripheral edges 40 and 54 respectively, for the adjustably tensioned snap-release joint to operate.

Figure 8:
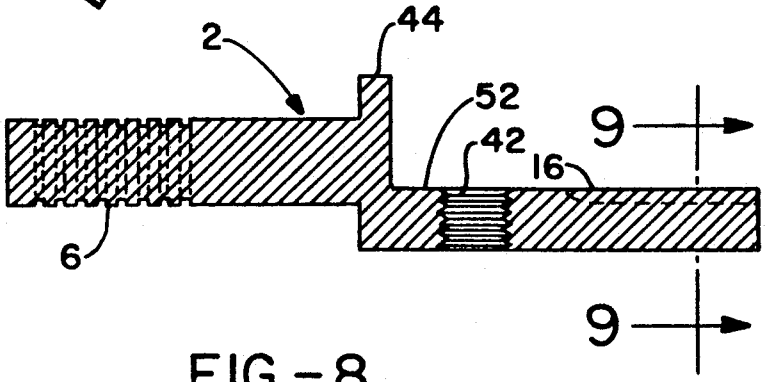
FIG. 8 is a cross-sectional view of the upper shaft insert of the exercise golf club taken along line 8—8 of FIG. 7.
Figure 7:
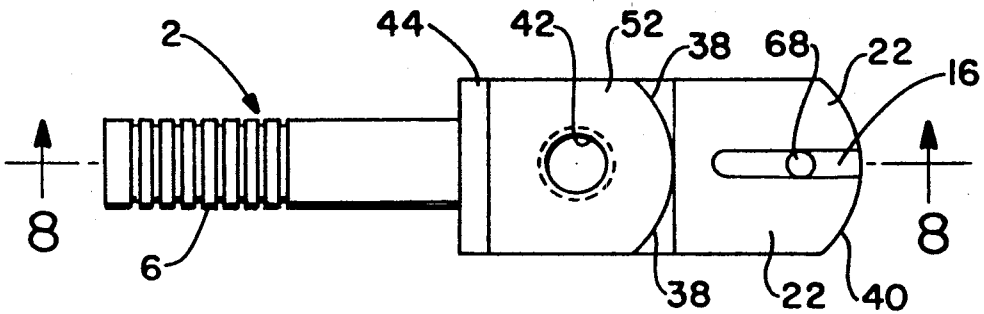
FIG. 7 is a top plan view of the upper shaft insert of the exercise golf club.

As viewed in greater detail in FIGS. 7 and 8, upper shaft insert 2 has several distinguishing features. Upper shaft insert includes exterior semicircular surface 20 through which threaded pivot screw receiving bore is positioned therethrough, curvilinear peripheral edge 40, circular raised segment 44, and planar interior surface 52. Key to the operation of adjustably tensioned snap-release joint 100 is the combination of non-beveled interior impinging surface 16 for the tensioned screw 52, beveled interior surface 22 and positioning means 68. In the machining of beveled surface 22, a pair of oblique surfaces 38 are created in upper shaft insert 2. As seen in the figure, non-beveled interior impinging surface 16 is essentially coplanar with planar interior surface 52.

Figure 9:
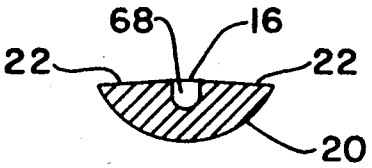
FIG. 9 is a cross-sectional view of the upper shaft insert taken along line 9—9 of FIG. 8.

As shown specifically in FIG. 9, positioning means 68 may be a groove. However, it is contemplated that positioning means may be any surface indentation which would tend to retain adjustably tensioned screw 32 in its indentation. Specifically, it is envisioned that positioning means 68 could be a hole.

Figure 10:
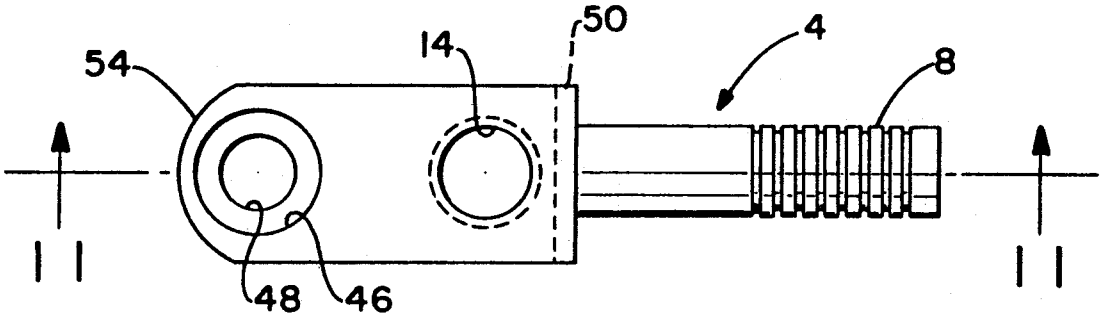
FIG. 10 is a top plan view of the lower shaft insert of the exercise golf club.

FIG. 10 depicts lower shaft insert 4 in greater detail. Specifically, lower shaft insert 4 includes exterior semicircular surface 18, through which adjustably tensioned threaded screw bore 14 and recessed pivot screw head bore 46 in combination with pivot screw shaft bore 48 extend therethrough, curvilinear peripheral edge 54 and planar interior face 56. Pivot screw 24 is positioned in the combination of recessed pivot screw head bore 46 and pivot screw shaft bore 48. Adjustably tensioned screw 32 is positioned into adjustably tensioned threaded bore 14.

Figure 13:
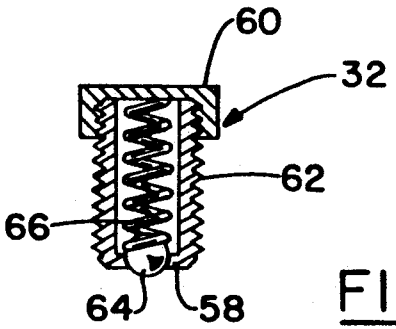
FIG. 13 is a cross-sectional view of the adjustably tensioned screw shown in FIG. 12.
Figure 12:
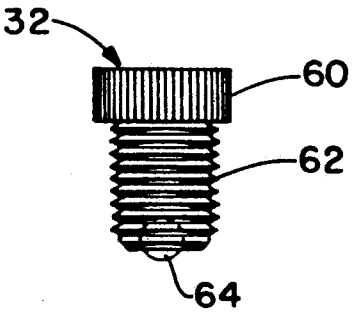
FIG. 12 is an elevational view of the adjustably tensioned screw.

The assembly of adjustably tensioned screw 32 is shown in FIGS. 12 and 13. Adjustably tensioned screw 32 includes adjustably tensioned screw head 60, screw threads 62, ball 64 which is peripherally biased by biasing means 66 located on the interior of screw threads 62. Ball 64 is maintained within the confines of the interior region of adjustably tensioned screw 32 by the existence of retaining means 58 at the lower extremity of the screw.

Placement of adjustably tensioned snap-release joint 100 into a golf club is determined by the location of the center of mass of the club. To determine such placement, the club is positioned on a fulcrum and the proper location is determined when the club remains balanced on the fulcrum with neither extremity of the club moving in a vertical direction. When the club is positioned in this manner, the attachment point for the adjustably tensioned snap-release joint 100 has been determined. Since the club face for an iron, or a club head for a wood, is typically of greater mass and weight than the grip, the snap-release joint will typically be positioned more closely to the club head or face than the grip. Alternative methods known in the art for determining the exact placement of the snap-release joint are envisioned.

The material of construction used in the adjustably tensioned snap-release joint, except where specifically indicated, is typically steel. In a preferred embodiment, a stainless steel is employed.

Discussion

Many faulty golf swings are the result of improper positioning of the hands vis-a-vis the golf club head. The average golfer often tries to correct such swing defects by the utilization of swing adjustments which typically result in a jerky, or non-smooth at best, swing. Many times the golfer is unaware of these subtle corrections in his swing as they become an almost subconscious action.

By using the adjustably tensioned snap-release joint in proper position in a golf club, the swing of a golfer can be self-analyzed by simply noting the position of the swing where the snap-release joint moves out of its normal linear alignment. For those golfers with very jerky swings, the adjustably tensioned screw may need to be positioned to generate a large degree of tension in order to be able to identify the most serious swing defects initially. By tightening the tensioning screw, additional pressure is applied to the upper shaft member through the shortened length imposed on the biasing spring thereby causing it to compress and generate additional force on the ball which impinges the upper shaft member of the snap-release joint.

As the major problems disappear, then tension on the tensioning spring can be gradually relaxed, thereby effecting a proportionate decrease in the amount of generated force applied to the upper shaft insert, and more minor swing defects can be detected and corrected.

One of the key features of the adjustably tensioned snap-release joint is the combination of a beveled surface in combination with a positioning means. Unlike previous devices, once the critical torque has been exerted which overcomes the tension generated by the tensioned screw, the beveled surface acts to accentuate the rotation action of the lower shaft insert in relation to the upper shaft insert. It is this cooperative interaction which aids in pinpointing the exact positioning of the swing flaw.

As is known from basic physical principles, the shaft acts as a lever arm and forces imparted through the hands are coupled with the shaft length to exert a moment or torque about the adjustably tensioned snap-release joint. When the generated torque exceeds the pressure applied to the upper shaft insert, the snap-release joint will move out of its co-linear alignment and the golfer is alerted instantly to the location of the position in the swing which has produced the undesirable result. The ability to adjust this trigger point pressure is key to detecting a series of flaws in the golf swing ranging from serious to minor.

The invention has been described with reference to the preferred embodiment. Obviously modifications and alterations will occur to others upon a reading and understanding of the specification. It is intended to include all such modifications and alterations insofar as they come within the scope of the appended claims or the equivalents thereof.

What is claimed is:

1. An adjustably tensioned snap-release joint for use as a golf club swing training device comprising:

(a) an upper shaft insert;

(b) a lower shaft insert;

(c) a screw inserted into a first bore in the lower shaft insert and inserted into a correspondingly threaded second bore in the upper shaft insert, the screw defining a rotation axis of the lower shaft member in relation to the upper shaft member to a transverse axis from a longitudinal axis defined by a linear alignment of the upper and lower shaft inserts in the golf club;

(d) an indentation positioned in a co-linear axis with the longitudinal axis of the golf club on an interior surface of the upper shaft insert; and (e) an adjustable screw assembly which further comprises:

an externally threaded shaft having a bore partially extending therethrough;

a head at a first end of the shaft;

a ball positioned at an opposed second end of the shaft;

a biasing means inside the threaded shaft maintaining an outward force upon the ball; and the adjustable screw assembly in the lower shaft insert positioned in communication with the positioning means of the upper shaft insert capable of exerting a variable amount of pressure on the groove thereby functioning to hold the upper and lower shaft inserts into a linear alignment and preventing rotation of the lower shaft until a torque is generated which exceeds a pressure on the indentation.

2. The adjustably tensioned snap-release joint of claim 1 wherein the indentation is a groove.

3. The adjustably tensioned snap-release joint of claim 1 wherein the biasing means is a spring.

4. The adjustably tensioned snap-release joint of claim 1 wherein the upper shaft insert further comprises:

(a) a shaft adapted for insertion into a golf club grip shaft at a first end;

(b) a circular raised segment adjacent to an opposed second end of the shaft;

(c) an exterior semicircular surface having a pivot screw receiving bore extending therethrough, the exterior semicircular surface extending along a longitudinal axis of the shaft projecting along said longitudinal axis from the circular raised segment;

(d) a curvilinear peripheral edge of the exterior semicircular surface to permit rotation;

(e) a planar interior surface partially extending along the longitudinal axis from the raised segment to the peripheral edge;

(f) a non-beveled interior impinging surface for the adjustable tensioning means extending from the peripheral edge to the planar interior surface;

(g) a positioning means in the non-beveled interior impinging surface; and (h) a beveled interior surface extending from the non-beveled interior impinging surface and from the planar interior surface to the peripheral edge and an edge of the exterior semicircular surface, the beveled interior surface cooperatively facilitating the movement of the adjustable tensioning means once a sufficient torque has been applied to the adjustable tensioning means to overcome a pressure on the positioning means thereby dislodging the upper and lower shaft inserts from the linear alignment and facilitating rotation.

5. The adjustably tensioned snap-release joint of claim 1 wherein the lower shaft insert further comprises:

(a) a shaft adapted for insertion into a golf club-head shaft at a first end;

(b) a circular raised segment at an opposed second end;

(c) a planar interior surface extending along a longitudinal axis of the shaft from the circular raised segment of a curvilinear peripheral edge; and (d) an exterior semicircular surface extending along the longitudinal axis of the shaft having an adjustably tensioned threaded screw bore extending therethrough at a first position and a recessed pivot screw head bore at a second position further along the axis toward the curvilinear peripheral edge partially extending therethrough with a pivot screw shaft bore extending from a terminal depth of the recessed pivot screw head bore to the planar interior surface, a diameter of the recessed pivot screw head bore being larger than a diameter of the pivot screw shaft bore.

* * * * *